US008356800B2

(12) United States Patent
Robinson

(10) Patent No.: US 8,356,800 B2
(45) Date of Patent: Jan. 22, 2013

(54) PROTECTIVE PADDING

(76) Inventor: Troy Robinson, Villa Park, CA (US)

( * ) Notice: Subject to any disclaimer, the term of this patent is extended or adjusted under 35 U.S.C. 154(b) by 176 days.

(21) Appl. No.: 12/799,022

(22) Filed: Apr. 16, 2010

(65) Prior Publication Data

US 2011/0253960 A1 Oct. 20, 2011

(51) Int. Cl.
*E04H 17/00* (2006.01)

(52) U.S. Cl. ..... 256/1; 256/73; 473/415

(58) Field of Classification Search ..... 256/1, 24, 256/25, 26, 29, 32, 33, 73; 160/229.1, 231.1; 52/71; 5/420, 99.1, 663, 946; 473/415
See application file for complete search history.

(56) References Cited

U.S. PATENT DOCUMENTS

| | | | | |
|---|---|---|---|---|
| 3,131,753 | A * | 5/1964 | Dixon | 160/183 |
| 4,222,428 | A * | 9/1980 | Scherer | 160/231.1 |
| 4,491,166 | A * | 1/1985 | Hanna | 160/229.1 |
| 6,149,998 | A * | 11/2000 | Hettinga | 160/231.1 |
| 6,481,030 | B2 * | 11/2002 | Bravo et al. | 5/425 |
| 7,350,772 | B2 * | 4/2008 | Legrand | 256/25 |
| 7,727,609 | B1 * | 6/2010 | Crasno | 482/23 |

* cited by examiner

*Primary Examiner* — Michael P Ferguson
(74) *Attorney, Agent, or Firm* — James E. Brunton

(57) ABSTRACT

A protective padding assembly for covering a section of chain link fence of the character found in sports venues, such as baseball fields, soccer fields, football fields and the like, wherein the section of chain link fence includes a hingeably connected swinging gate. The protective padding assembly uniquely includes a fence covering section, a gate covering section and an intermediate, wedge shaped portion for covering the gate hinges in a manner that will not interfere with opening and closing the gate.

6 Claims, 7 Drawing Sheets

PROTECTIVE PADDING

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of Invention

The present invention relates generally to protective padding. More particularly, the invention concerns a novel protective padding assembly for covering a section of a barrier, such as a fence having a swinging gate, the protective padding assembly including a fence covering section, a gate covering section and an intermediate, wedge shaped section for covering the gate hinge in the manner that will not interfere with opening and closing the gate.

2. Description of Related Art Including Information Disclosed Under 37 Cfr 1.97 and 1.98

Protective padding of various kinds has long been used to cover perimeter fences at a number of different types of sports venues including baseball fields, soccer fields, football fields and the like. Perimeter fences typically include a series of posts set in the ground with a fencing material, such as chain-link fencing, spanning the posts. Typically, the prior art protective padding comprises plywood panels covered with vinyl encased, high impact foam that are connected to the chain link fence using plastic washers that are bolted to the back of the protective padding assemblies.

To provide a gate in an opening of the fence, a pipe work frame the size of the opening is typically hinged to one side of the opening. A latch mechanism of some type is then attached to the opposite side of the opening and is used to maintain the gate in the closed position. Covering the gate and the gate hinges with a protective padding in a manner such that the gate can be freely opened and closed has long presented a very troublesome problem. The thrust of the present invention is to solve this troublesome prior art problem by providing a uniquely constructed protective padding assembly that includes a gate pad and a cooperatively associated generally wedge shaped insert of novel design that covers the gate hinge. When the gate is closed, the wedge shaped insert cooperates with the gate pad and with the pad covering the section of fence located adjacent the gate to provide a continuous length of protective pad.

BRIEF SUMMARY OF THE INVENTION

It is an object of the present invention to provide a novel protective padding assembly for covering a section of a barrier having a swinging gate, the protective padding assembly including a barrier covering section, a gate covering section and an intermediate, wedge shaped portion for covering the gate hinge in the manner that will not interfere with opening and closing the gate.

Another object of the invention is to provide a protective padding assembly of the aforementioned character that is of a simple construction and one that is easy to interconnect with a conventional section of a barrier such as a fence having a swinging gate.

Another object of the invention is to provide a protective padding as described in the preceding paragraphs that effectively prevents injury to an athlete accidentally running into the swinging gate and the hinge portion of the swinging gate.

Another object of the invention is to provide a protective padding of the character described that is sturdy in use and attractive in appearance.

Another object of the invention is to provide a protective padding of the class described in the preceding paragraphs that is inexpensive to manufacture, is reliable in operation and has a relatively long, useful life.

DETAILED DESCRIPTION OF THE INVENTION

Figure 1:
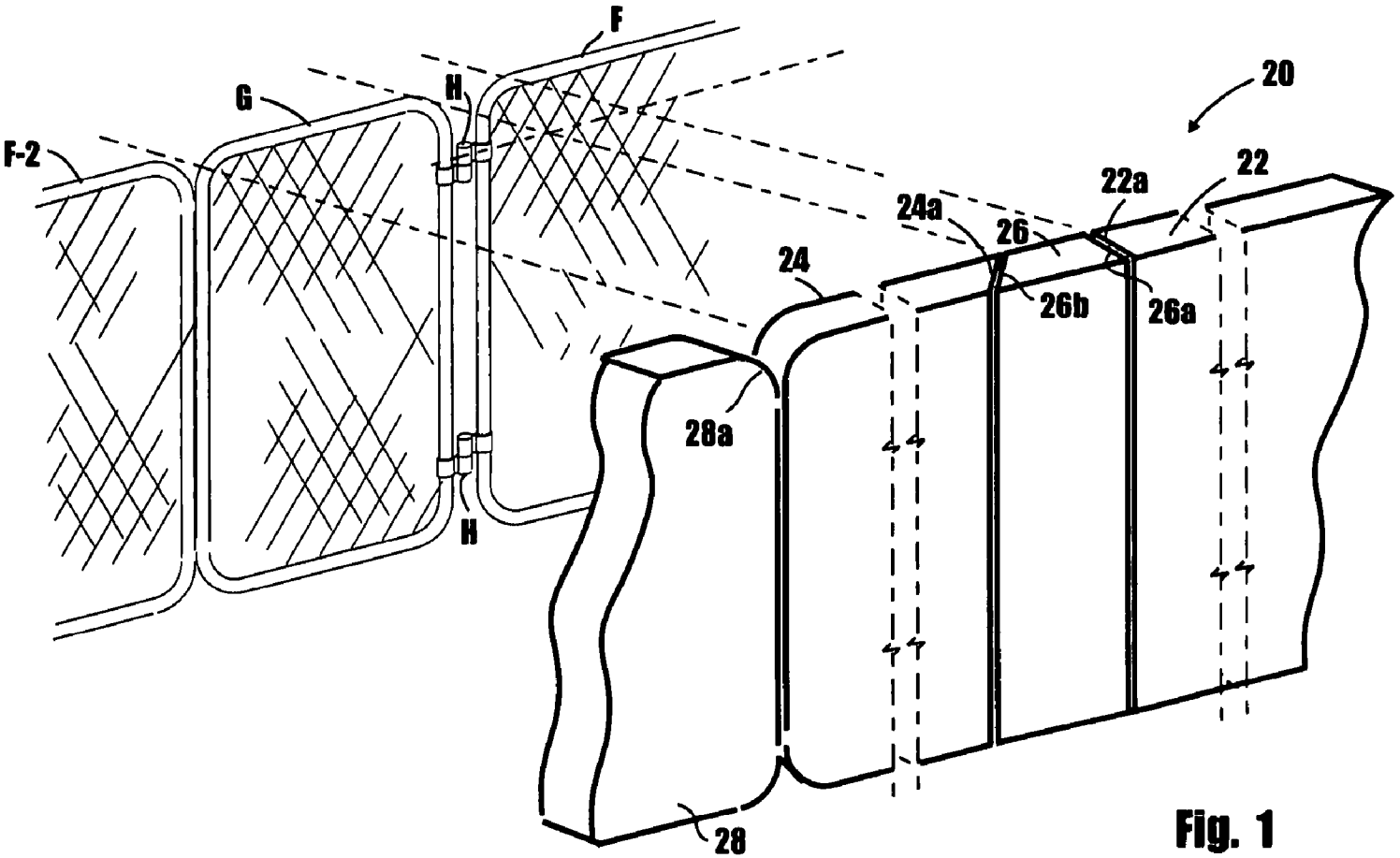
FIG. 1 is a generally perspective, exploded view showing one form of the protective padding apparatus of the invention shown spaced apart from the chain-link fence and swinging gate to which the protective padding apparatus is to be attached.
Figure 2:
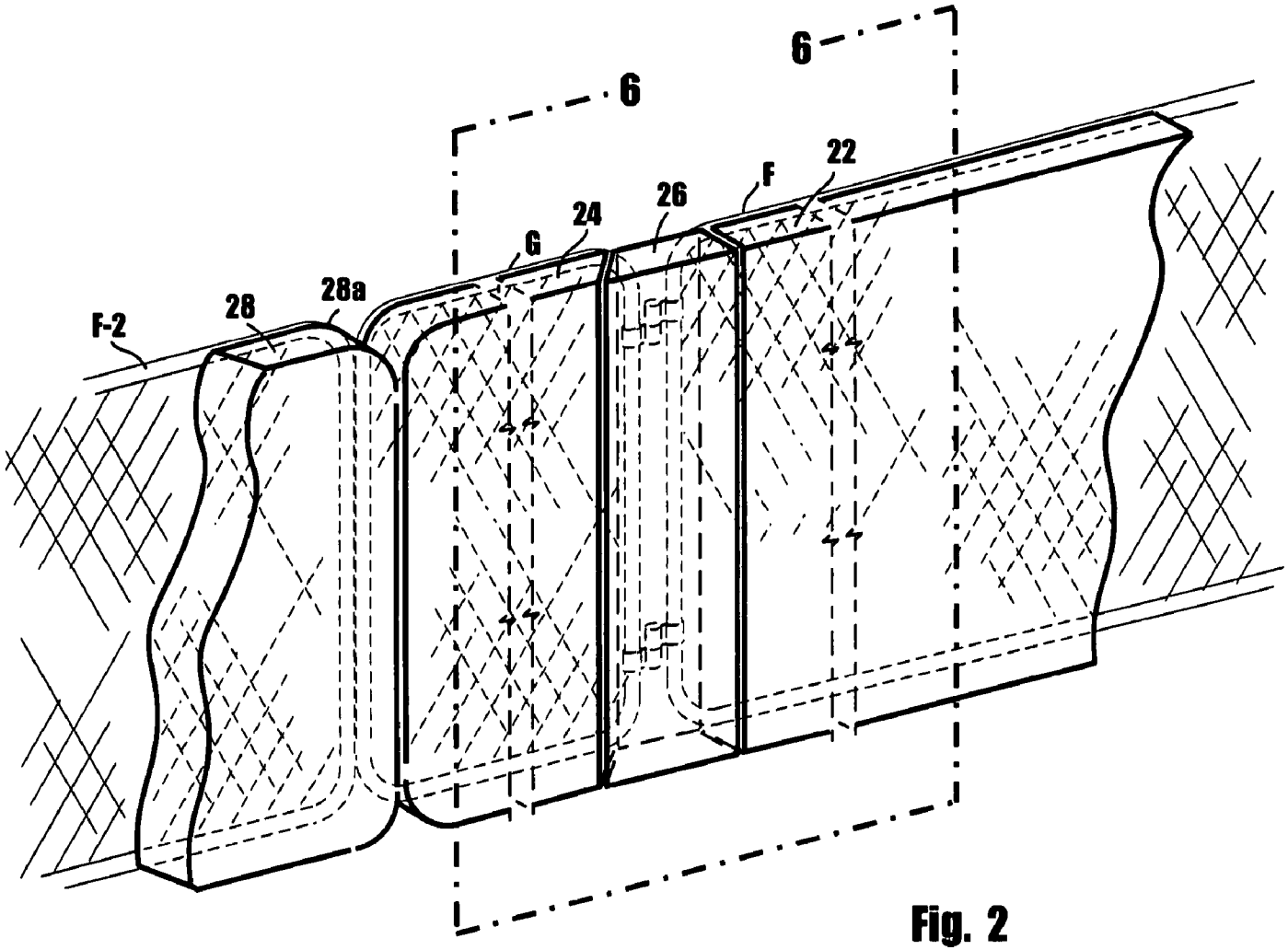
FIG. 2 is a generally perspective, front view, similar to FIG. 1, but showing the protective padding apparatus of the invention interconnected with the chain-link fence and swinging gate.

Referring to the drawings and particularly to FIGS. 1 and 2, one form of the protective padding assembly of the present invention is there shown and generally designated by the numeral 20. Protective padding assembly 20 is specially designed for covering a section of a barrier, such as a chain-link fence comprising a continuous barrier portion, such as the chain-link fence portion "F" and a swinging gate such as a chain-link swinging gate "G" that is connected to the chain-link fence portion by a pair of spaced apart hinges "H". It is to be understood that, while the barrier is shown in the drawings as a chain link fence, the protective padding assembly can be used in connection with various types of barriers, such as wooden fences, partition walls and like structures that include a hingeable connected swinging gate.

As illustrated in FIGS. 1 and 2 of the drawings, protective padding assembly 20 here comprises a first section 22 that is connected to the continuous chain-link fence portion "F", a second section 24 that is connected to the chain-link swinging gate, and an intermediate portion 26 that is disposed between the first and second sections. First section 22 has a tapered end portion 22*a* and second section 24 has a tapered end portion 24*a*. As best seen by referring to FIGS. 3A and 4A, intermediate portion 26 has a first tapered edge 26*a* that is disposed in close proximity with tapered edge 22*a* of first section 22 when the intermediate portion 26 is in the first gate closed position shown in FIG. 4A. Similarly, intermediate portion 26 has a second tapered edge 26*b* that is disposed in close proximity with tapered edge 24*a* of first section 24 when the intermediate portion 26 is in the first gate closed position. As indicated in the drawings, when the gate is closed, end portion 24*b* of the gate pad is in close proximity with the end portion 28*a* of the protective pad 28 that is affixed to the fence section "F-2" that is located proximate the free and of the gate "G".

As illustrated in FIGS. 4B, 4C, 4D and 5, and as will be discussed in greater detail in the paragraphs which follow, as the gate "G" is opened, intermediate portion 26 is movable between the first gate closed position wherein it is overlying the hinges "H" and a second position wherein it is spaced apart from the hinges.

Figure 3:
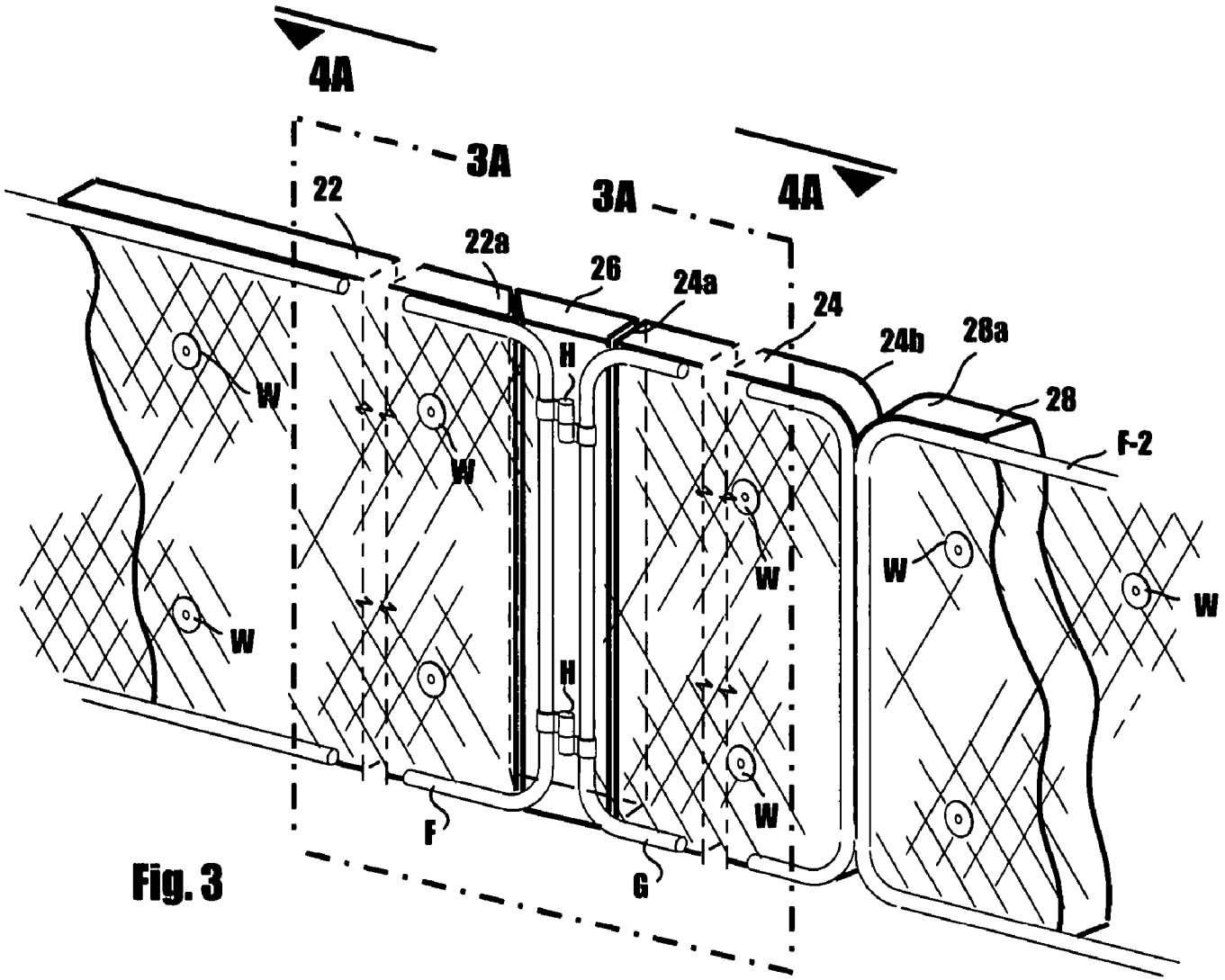
FIG. 3 is a generally perspective, rear view, similar to FIG. 2 showing the protective padding apparatus of the invention interconnected with the chain-link fence and swinging gate.

As is conventional in the prior art, each of the protective pad portions 22, 24 and 26 comprise a high impact foam pad having a vinyl coating. As is also conventional in the prior art, each of the protective pad portions is connected to a plywood panel that provides rigidity to the protective pad assemblies. As indicated in FIG. 3 of the drawings, the protective pad assemblies are interconnected with the sections of chain-link fence and with the chain-link gate by means of plastic washers "W" that are bolted to the back of the protective padding assemblies.

Figure 4A:
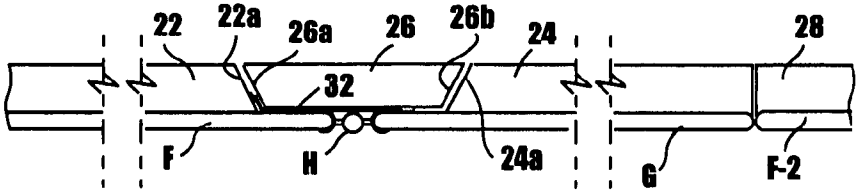
FIG. 4A is a view taken along lines 4A-4A of FIG. 3.
Figure 4B:
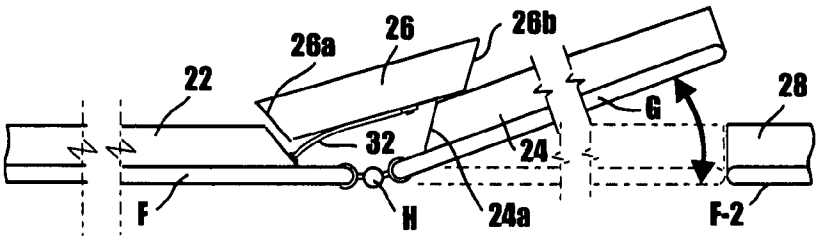
FIG. 4B is a view similar to FIG. 4A, but showing the gate partially open.

Referring particularly to FIG. 4B of the drawings, as the gate is swung into the open position shown in FIG. 4B, tapered edge 26*b* of intermediate portion 26 will slide up tapered end portion 24*a* of first section 24 and will move into the position shown in FIG. 4B where it rests on the outer surface of first section 24 and is spaced apart from the hinges "H". As the gate is further opened into the position shown in FIG. 4C of the drawings, the inner edge 26*c* of the intermediate portion will slide along the outer surface of first section 24 against the urging of the biasing means of the invention, into the position shown in FIG. 4C. As best seen in FIG. 5 of the drawings, this important biasing means of the invention, which yieldably resists movement of said intermediate portion away from its at-rest position shown in FIG. 4A, here comprises three vertically spaced apart, stretchable elastomeric cords. More particularly, the biasing means of the invention comprises an elongate, stretchable first cord 32 having a first end 32*a* connected to a tapered end portion of first section 22 and a second end 32*b* connected to the inner surface of intermediate portion 26. The biasing means also comprises an elongate, stretchable second cord 34 having a first end 34*a* connected to a tapered end portion of first section 22 and a second end 34*b* connected to the inner surface of intermediate portion 26. Additionally, the biasing means here comprises an elongate, stretchable third cord 36 having a first end 36*a* connected to a tapered end portion of first section 22 and a second end 36*b* connected to the inner surface of intermediate portion 26. While the biasing means is here shown as comprising a plurality of stretchable, elastomeric cords, it is to be understood that the biasing means could be provided in several forms including coil springs, torsion springs and a variety of other spring constructions.

Figure 3A:
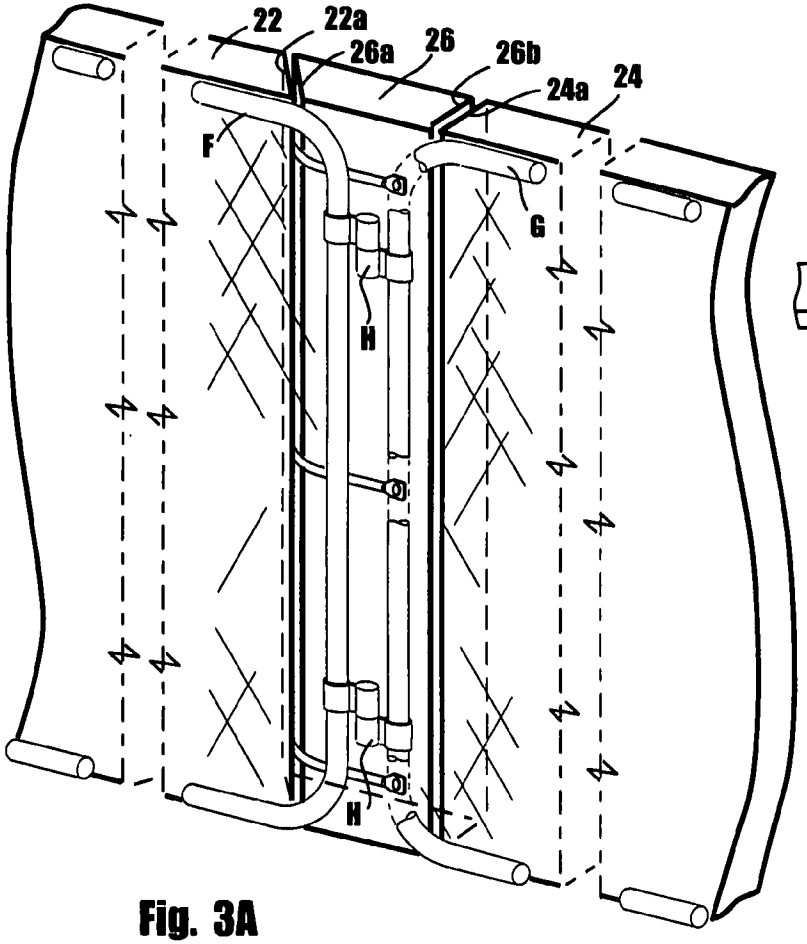
FIG. 3A is a generally perspective, enlarged view of the area designated in FIG. 3 as 3A-3A.
Figure 4C:
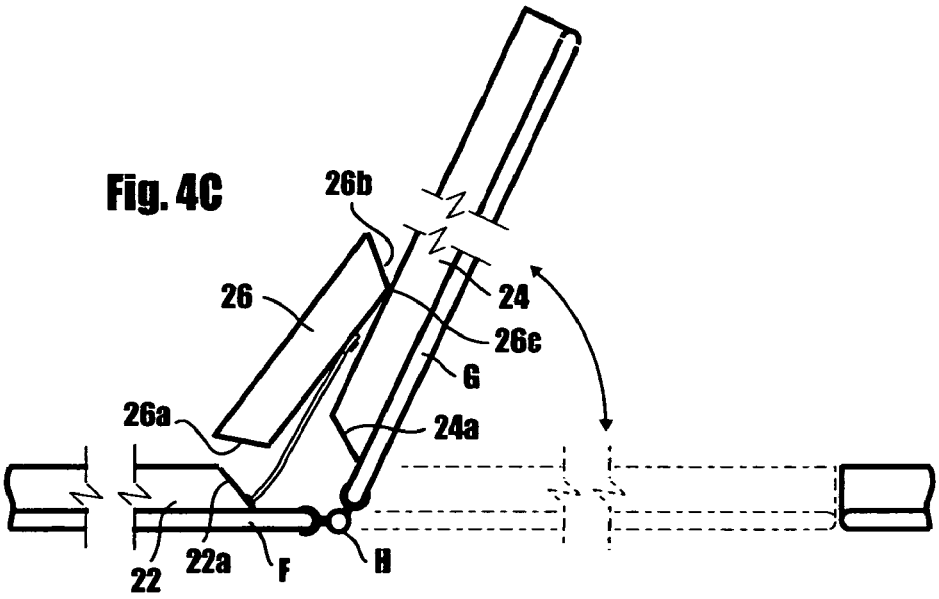
FIG. 4C is a view similar to FIG. 4B, but showing the gate opened further.
Figure 4D:
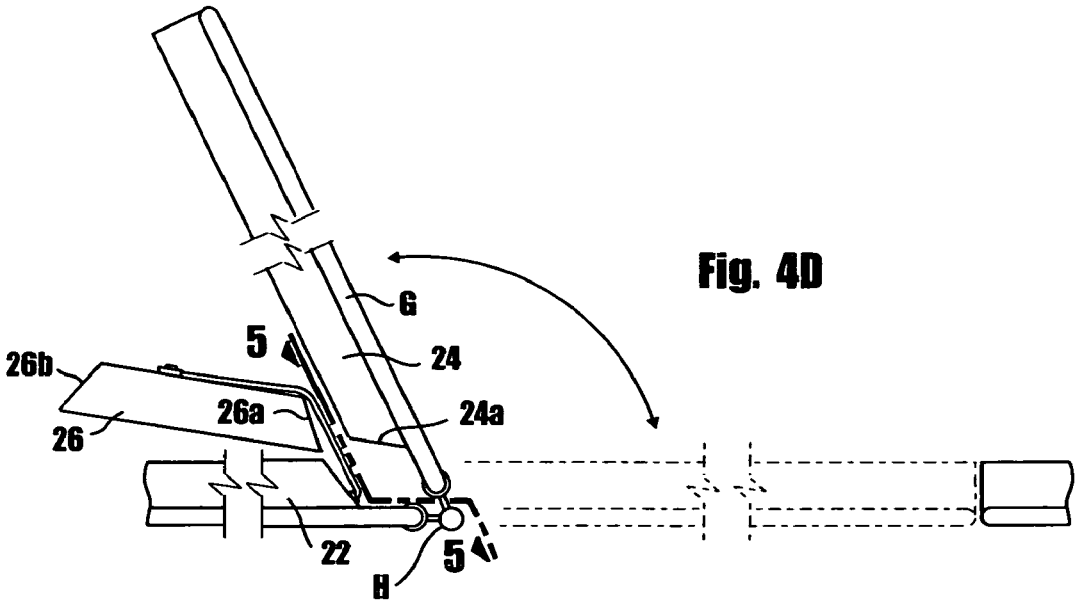
FIG. 4D is a view similar to FIG. 4C but showing the gate completely open.
Figure 5:
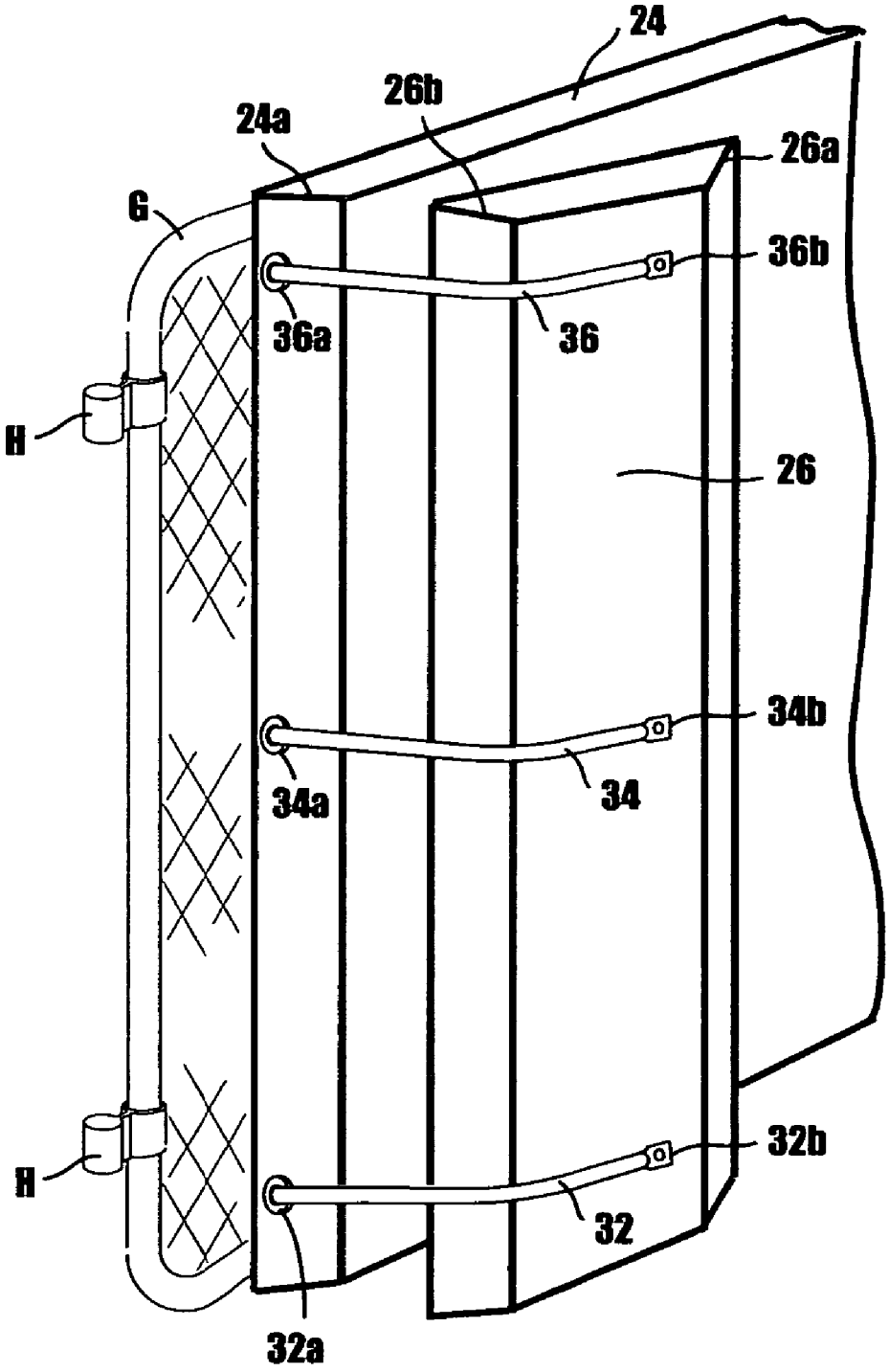
FIG. 5 is a generally perspective, fragmentary view showing the relative positions of the gate pad and the intermediate wedge portion when the gate is in the open position and showing the elastomeric, wedge biasing cords of the apparatus in an extended configuration.

As the gate continues to be opened into the position shown in FIG. 4D of the drawings, the intermediate portion 26 will be forced downwardly against the further urging of the biasing means of the invention in a direction toward the outer surface of the first section into the position shown in FIG. 4C. As can be observed by a study of FIG. 4D, when the intermediate portion 26 has been moved into the position shown in FIG. 4D, each of the stretchable elastomeric cords has been significantly stretched from its at-rest position. Accordingly, when the gate "G" is once again moved into the closed position, the elastomeric cords 32, 34 and 36 will act upon the intermediate portion 26, positively urging it into its starting position as shown in FIGS. 3A and 4A of the drawings.

Figure 6A:
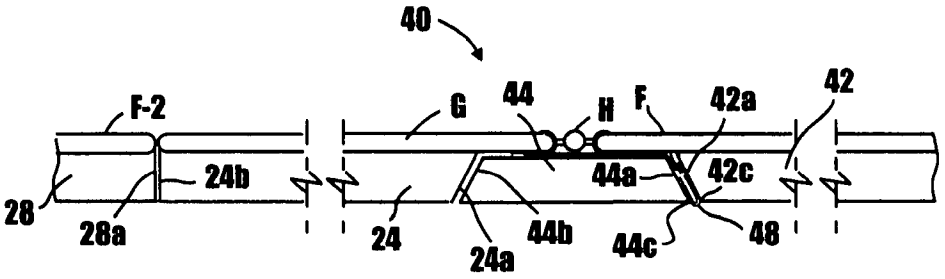
FIG. 6A is a view taken along lines 6A-6A of FIG. 6.
Figure 6B:
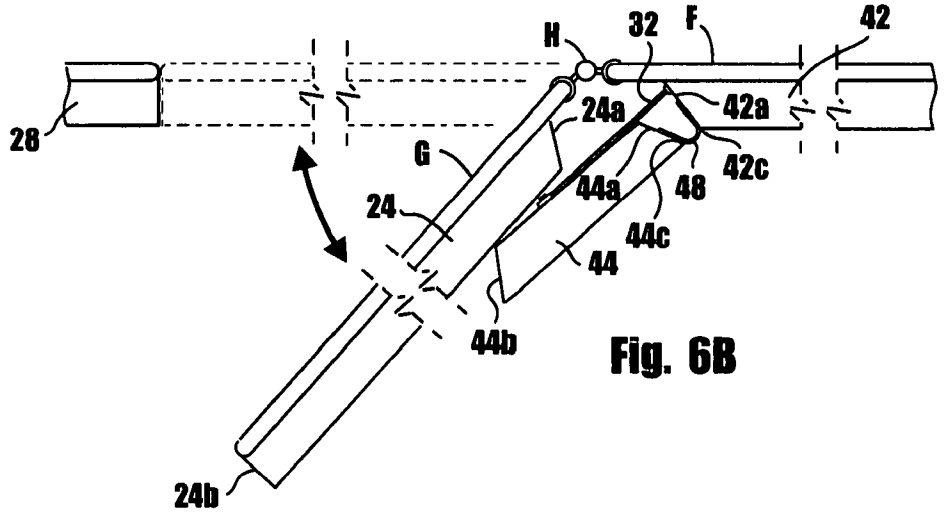
FIG. 6B is a view similar to FIG. 6, but showing the gate partially open.

Referring next to FIGS. 6A and 6B of the drawings, an alternate form of the protective padding assembly of the present invention is there shown and generally designated by the numeral 40. This latest form of the invention is similar in many respects to the earlier described embodiment and like numerals are used in FIGS. 6, 6A and 6B to identify like components. As in the earlier described embodiment of the invention, protective padding assembly 40 is specially designed for covering a barrier such as a section of chain-link fence comprising a chain-link fence portion "F" and a chain-link swinging gate "G" that is connected to the chain-link fence portion by a pair of spaced apart hinges "H".

As illustrated in FIGS. 6A and 6B of the drawings, protective padding assembly 40 here comprises a first section 42 that is connected to the chain-link fence portion "F", a second section 24 that is connected to the chain-link swinging gate, and an intermediate portion 44 that is disposed between the first and second sections. First section 42 has a tapered end portion 42*a* that terminates in an outer edge portion 42*c*. Similarly, second section 24 has a tapered end portion 24*a*. As best seen by referring to FIG. 6A, intermediate portion 44 has a first tapered edge 44*a* that is disposed in close proximity with tapered edge 42*a* of first section 42 when the intermediate portion 44 is in the first gate closed position shown in FIG. 6A. Similarly, intermediate portion 44 has a second tapered edge portion 44*b* that is disposed in close proximity with tapered edge 24*a* of first section 24 when the intermediate portion 44 is in the first gate closed position. The tapered edge 44*a* of intermediate portion 44 terminates in an outer edge portion 44*c*. As indicated in the drawings, when the gate is closed, end portion 24*b* of the gate pad is in close proximity with the end portion 28*a* of the protective pad 28 that is affixed to the fence section "F-2" that is located proximate the free and of the gate "G" (FIG. 6A).

As before, as the gate "G" is opened, intermediate portion 44 is movable between the first gate closed position wherein it is overlying the hinges "H" and a second position wherein it is spaced apart from the hinges (FIG. 6B).

As is conventional in the prior art, each of the protective pad portions 42, 24 and 44 comprise a high impact foam pad having a vinyl coating. As is also conventional in the prior art, each of the protective pad portions is connected to a plywood panel that provides rigidity to the protective pad assemblies. Similarly, the protective pad assemblies are interconnected with the sections of chain-link fence and with the chain-link gate by means of plastic washers that are bolted to the back of the protective padding assemblies.

Figure 6:
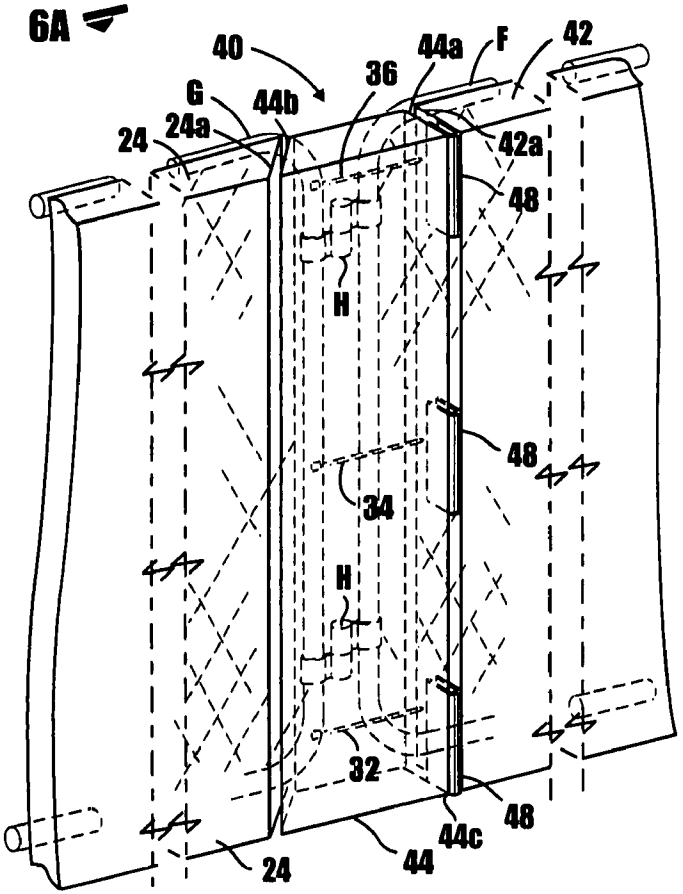
FIG. 6 is a generally perspective, fragmentary view of an alternate form of the protective padding apparatus of the invention.

The primary difference between this latest embodiment of the invention and the earlier described embodiment resides in the fact that the outer edge portions of the first section 42 and of the intermediate section 44 are hingeably interconnected. More particularly, outer edge portion 42*c* of first section 42 is hingeably interconnected with outer edge portion 44*c* of intermediate section 44. While these sections can be hingeably interconnected in various ways, they are here interconnected by a plurality of vertically spaced apart fabric hinges 48 (FIG. 6).

Referring particularly to FIG. 6B of the drawings, as the gate is swung into the open position there shown, tapered edge 44*b* of intermediate portion 44 will slide up tapered end portion 24*a* of first section 24 and will move into the position shown in FIG. 6B, where it rests on the outer surface of first section 24 and is spaced apart from the hinges "H". As the intermediate portion 44 moves into the position shown in FIG. 6B, the outer edge of section 44 will pivot about the outer edge of the first section 42, in the manner illustrated in FIG. 6B.

Once again, biasing means are provided to yieldably resist movement of intermediate portion 44 away from its at-rest position as shown in FIG. 6A. This important biasing means which is substantially identical in construction and operation to the previously described biasing means, here comprises three vertically spaced apart, stretchable elastomeric cords 32, 34 and 36 that are connected in the manner previously described and that operate in the manner previously described. While the biasing means is here shown as comprising a plurality of stretchable, elastomeric cords, it is to be understood that the biasing means could be provided in several forms including coil springs, torsion springs and a variety of other spring constructions.

As the gate continues to be opened, the intermediate portion 44 will be forced downwardly against the further urging of the biasing means of the invention in a direction toward the outer surface of first section 42. When the intermediate portion 44 has been moved into this position, each of the stretchable elastomeric cords will have been significantly stretched from the at-rest position. Accordingly, when the gate "G" is once again moved into the closed position, the elastomeric cords 32, 34 and 36 will act upon the intermediate portion 44, positively urging it into its starting position as shown in FIG. 6A of the drawings.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

The invention claimed is:

1. A protective padding assembly covering a section of chain-link fence comprising a chain-link fence portion and a chain-link swinging gate connected to the chain-link fence portion by a pair of spaced apart hinges, said protective padding assembly comprising:

(a) a first section connected to the chain-link fence portion, said first section comprising a foam pad having a vinyl coating and a tapered end portion;

(b) a second section connected to the chain-link swinging gate, said second section comprising a foam pad having a vinyl coating and having a tapered end portion;

(c) an intermediate portion connected to said first section and disposed between said first and second sections, said intermediate portion having an inner surface and being movable relative to said first and second sections between a first position overlaying the spaced apart hinges when the gate is closed and a second position spaced apart from the hinges when the gate is swung open, said intermediate portion comprising a foam pad having a vinyl coating and having a first tapered end portion disposed in close proximity to said tapered end portion of said first section when said intermediate portion is in said first position and a second tapered end portion disposed in close proximity to said tapered end portion of said second section when said intermediate portion is in said first position, wherein in the second position the second tapered end portion of the intermediate portion slidably disengages the tapered end portion of the second section such that the intermediate portion overlays the second section; and (d) biasing means for yieldably resisting movement of said intermediate portion toward said second position, said biasing means comprising:

(i) a first elongate, stretchable cord having a first end connected to said tapered end portion of said first section and a second end connected to said inner surface of said intermediate portion;

(ii) a second elongate, stretchable cord having a first end connected to said tapered end portion of said first section and a second end connected to said inner surface of said intermediate portion; and (iii) a third elongate, stretchable cord having a first end connected to said tapered end portion of said first section and a second end connected to said inner surface of said intermediate portion.

2. The protective padding assembly as defined in claim 1 in which said tapered end portion of said first section terminates in a first section outer edge portion and in which said intermediate portion terminates in an outer edge portion disposed in proximity to said outer edge portion of said first section.

3. The protective padding assembly as defined in claim 2 in which said outer edge portions of said first section and said outer edge portions of said intermediate portions are hingeably interconnected.

4. A protective padding assembly covering a section of a barrier comprising a continuous portion and a swinging gate connected to the continuous portion by a hinge, said protective padding assembly comprising:

(a) a first section connected to the continuous portion, said first section having a tapered edge;

(b) a second section connected to the swinging gate, said second section having a tapered edge; and (c) an intermediate portion connected to said first section and disposed between said first and second sections, said intermediate portion having an inner surface, a first tapered edge disposed in close proximity to said tapered edge of said first section and a second tapered edge disposed in close proximity to said tapered edge of said second section, said intermediate portion being movable relative to said first and second sections between a first position overlying the hinge when the date is closed and a second position spaced apart from the hinge when the gate is swung open, wherein in the second position the second tapered edge of the intermediate portion slidably disengages the tapered edge of the second section such that the intermediate portion overlays the second section; and (d) biasing means connected to said edge of said first section and to said inner surface of said intermediate portion for yieldably resisting movement of said intermediate portion toward the second position, said biasing means comprising an elastomeric cord having a first end connected to said tapered edge of said first section and a second end connected to said inner surface of said intermediate portion.

5. The protective padding assembly as defined in claim 4 in which said biasing means comprises a plurality of elastomeric cords connected to said tapered end of said first section and to said inner surface of said intermediate section.

6. A protective padding assembly covering a section of fence comprising a fence portion and a swinging gate connected to the fence portion by a pair of spaced apart hinges, said protective padding assembly comprising:

(a) a first section connected to the fence portion, said first section having a tapered edge;

(b) a second section connected to the swinging gate, said second section having a tapered edge;

(c) an intermediate portion connected to said first section and disposed between said first and second sections, said intermediate portion having an inner surface and being movable relative to said first and second sections between a first position overlaying the spaced apart hinges when the gate is closed and a second position spaced apart from the hinges when the gate is swung open, said intermediate portion having a first tapered edge disposed in close proximity to said tapered edge of said first section when said intermediate portion is in said first position and a second tapered edge disposed in close proximity to said tapered edge of said second section when said intermediate portion is in said first position, wherein in the second position the second tapered edge of the intermediate portion slidably disengages the tapered edge of the second section such that the intermediate portion overlays the second section; and (d) biasing means connected to said first section for yieldably resisting movement of said intermediate portion toward said second position, said biasing means comprising a plurality of elastomeric cords, each connected to said tapered edge of said first section and to said inner surface of said intermediate portion.

* * * * *